US010190813B2

(12) United States Patent
Chung et al.

(10) Patent No.: US 10,190,813 B2
(45) Date of Patent: Jan. 29, 2019

(54) REFRIGERATOR AND METHOD FOR CONTROLLING THE SAME

(71) Applicant: LG ELECTRONICS INC., Seoul (KR)

(72) Inventors: Myungjin Chung, Seoul (KR); Namsoo Cho, Seoul (KR); Kyongbae Park, Seoul (KR); Jangseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 63 days.

(21) Appl. No.: 15/029,227

(22) PCT Filed: Jan. 21, 2016

(86) PCT No.: PCT/KR2016/000655
§ 371 (c)(1),
(2) Date: Apr. 13, 2016

(87) PCT Pub. No.: WO2016/117942
PCT Pub. Date: Jul. 28, 2016

(65) Prior Publication Data

US 2016/0356539 A1 Dec. 8, 2016

(30) Foreign Application Priority Data

Jan. 21, 2015 (KR) ..... 10-2015-0009909

(51) Int. Cl.
*F25D 21/04* (2006.01)
*F25D 23/02* (2006.01)
(Continued)

(52) U.S. Cl.
CPC ..... *F25D 21/04* (2013.01); *F25D 11/02* (2013.01); *F25D 23/02* (2013.01); *F25D 23/069* (2013.01);
(Continued)

(58) Field of Classification Search
CPC ..... F25D 21/04; F25D 23/069; F25D 11/02; F25D 23/02; F25D 2700/00; F25D 2700/14
See application file for complete search history.

(56) References Cited

U.S. PATENT DOCUMENTS 8,539,783 B1 * 9/2013 Bunch ..... A47F 3/0482 62/150
2005/0120728 A1 * 6/2005 Carter ..... F25D 21/04 62/151
(Continued)

FOREIGN PATENT DOCUMENTS

EP 2 161 521 A1 3/2010
EP 2161521 A2 * 3/2010 ..... F25D 21/08
(Continued)

OTHER PUBLICATIONS

Korean Office Action dated Mar. 14, 2016 issued in Application No. 10-2015-0009909.
(Continued)

*Primary Examiner* — Devon Russell
(74) *Attorney, Agent, or Firm* — KED & Associates, LLP

(57) ABSTRACT

Provided are a refrigerator and a method for controlling the same. The refrigerator includes a cabinet defining a storage compartment, a door selectively opening or closing the storage compartment, a heater disposed in the cabinet or door to prevent dew from being formed on a surface of the cabinet or door, a refrigerator temperature sensor detecting a temperature of the storage compartment of the refrigerator, and a control unit adjusting an operation factor or output of the heater on the basis of a temperature value detected by the refrigerator temperature sensor.

7 Claims, 11 Drawing Sheets

(51) Int. Cl.

| | |
|---|---|
| ***F25D 23/06*** | (2006.01) |
| ***F25D 11/02*** | (2006.01) |
| *F25D 29/00* | (2006.01) |

(52) U.S. Cl.

CPC ..... *F25D 29/00* (2013.01); *F25D 29/003* (2013.01); *F25D 2323/021* (2013.01); *F25D 2323/023* (2013.01); *F25D 2400/02* (2013.01); *F25D 2700/00* (2013.01); *F25D 2700/12* (2013.01); *F25D 2700/14* (2013.01)

(56) References Cited

U.S. PATENT DOCUMENTS

| | | | | |
|---|---|---|---|---|
| 2005/0229614 | A1* | 10/2005 | Ansted | A47F 3/0482 62/150 |
| 2015/0115790 | A1* | 4/2015 | Ogg | F25D 23/069 312/404 |
| 2015/0143831 | A1* | 5/2015 | Chou | F28F 3/14 62/129 |
| 2015/0285551 | A1* | 10/2015 | Aiken | F25D 21/006 62/80 |
| 2016/0025404 | A1* | 1/2016 | Zheng | F25D 21/04 62/80 |
| 2016/0040860 | A1* | 2/2016 | Thomas | A47F 3/001 362/92 |

FOREIGN PATENT DOCUMENTS

| | | | | |
|---|---|---|---|---|
| JP | 2014240724 | A * | 12/2014 | |
| KR | 10-1999-0017486 | A | 3/1999 | |
| KR | 10-0213147 | B1 | 8/1999 | |
| KR | 10-0556252 | B1 | 3/2006 | |
| KR | 10-0577124 | B1 | 5/2006 | |
| KR | 100577124 | B1 * | 5/2006 | |
| KR | 10-2007-0019232 | | 2/2007 | |
| KR | 10-2014-0093331 | A | 7/2014 | |
| WO | WO 2014139141 | A1 * | 9/2014 | F25D 21/04 |

OTHER PUBLICATIONS

International Search Report dated Apr. 12, 2016 issued in Application No. PCT/KR2016/000655 (Full English Text).

* cited by examiner

[Fig. 1]
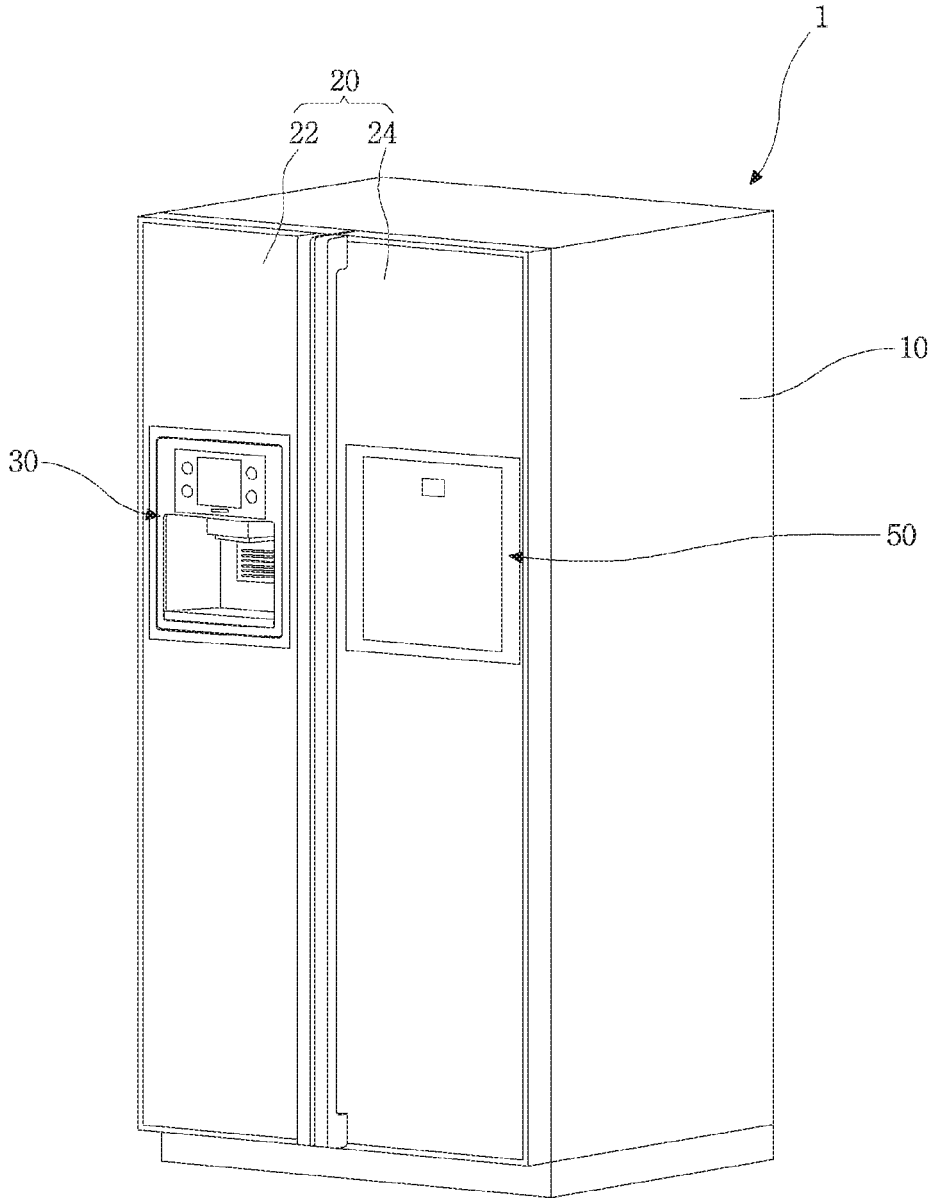

[Fig. 2]
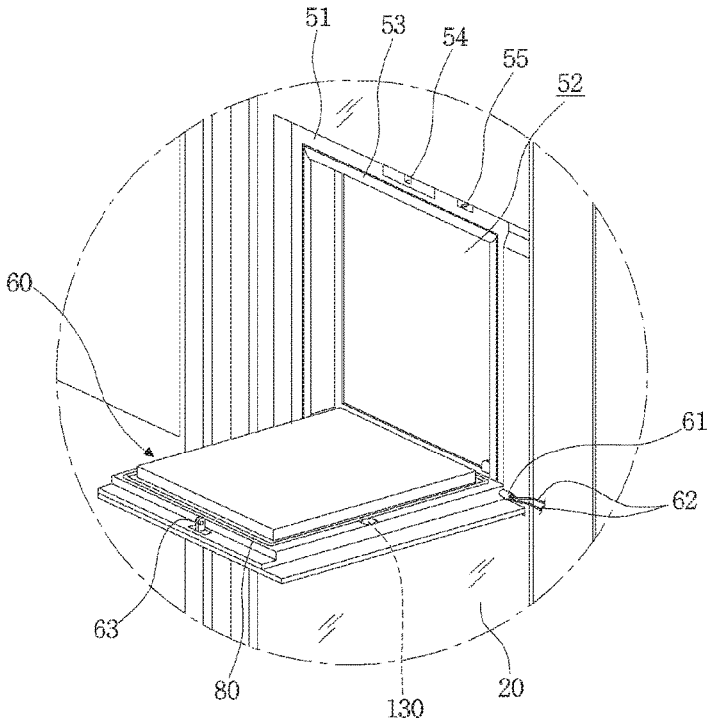
[Fig. 3]
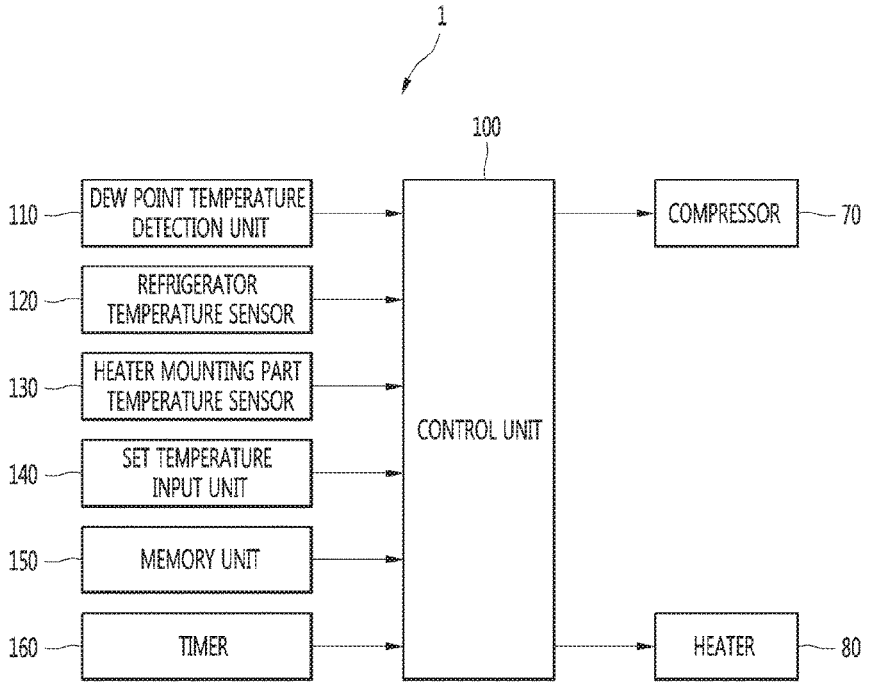

[Fig. 4]
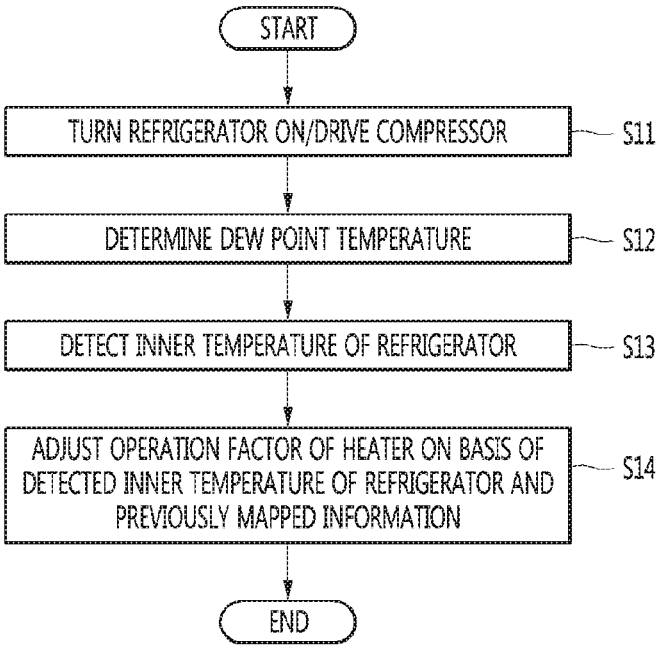

[Fig. 5]
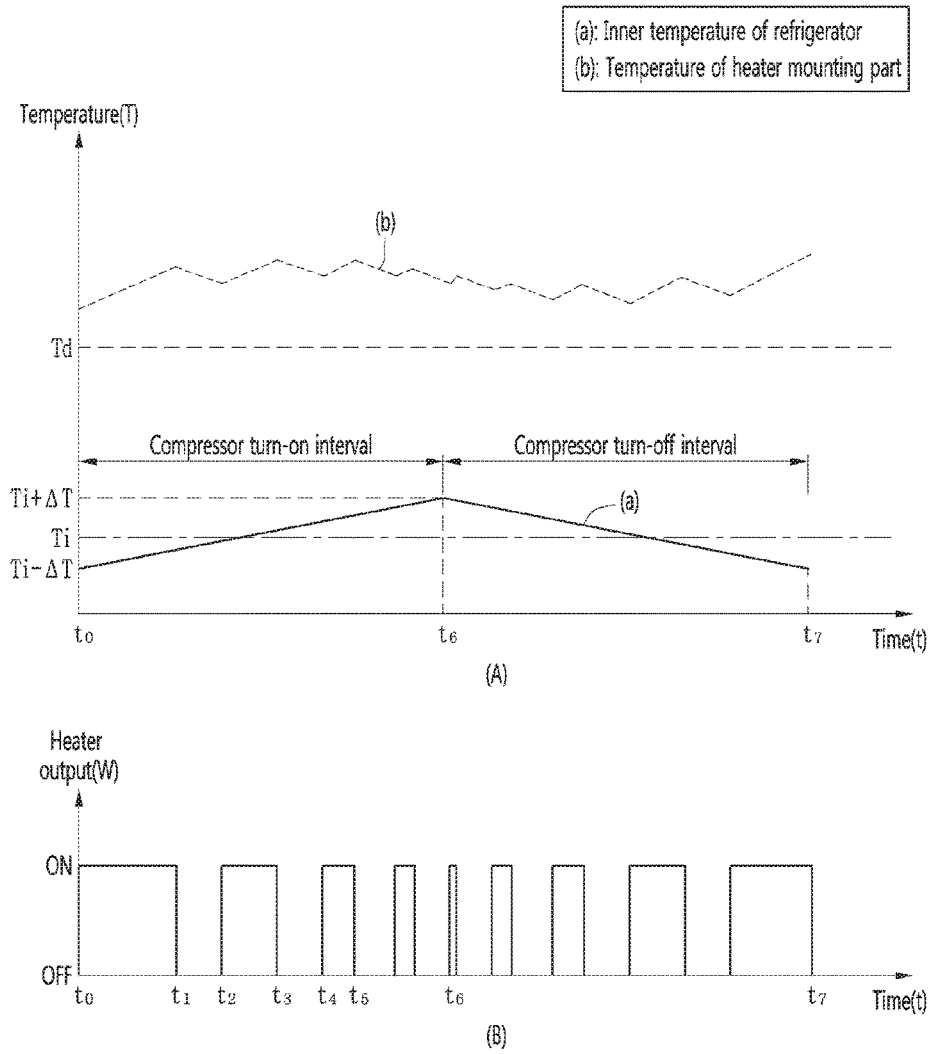

[Fig. 6]
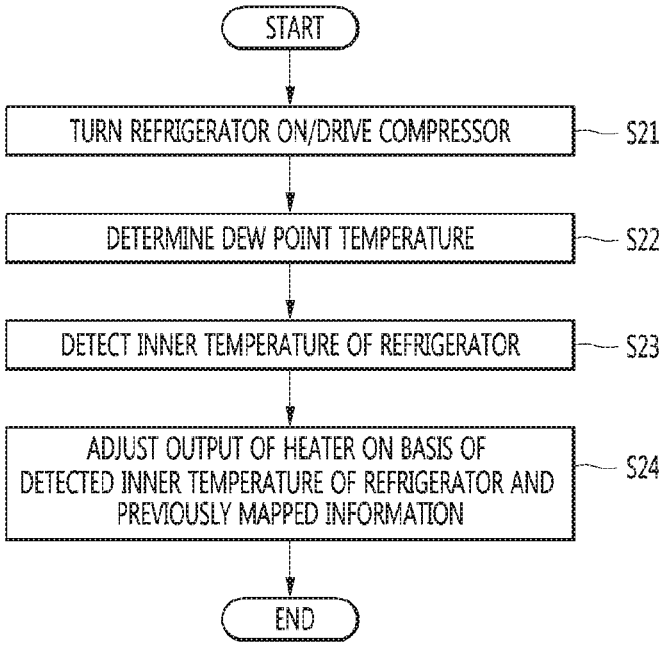

[Fig. 7]
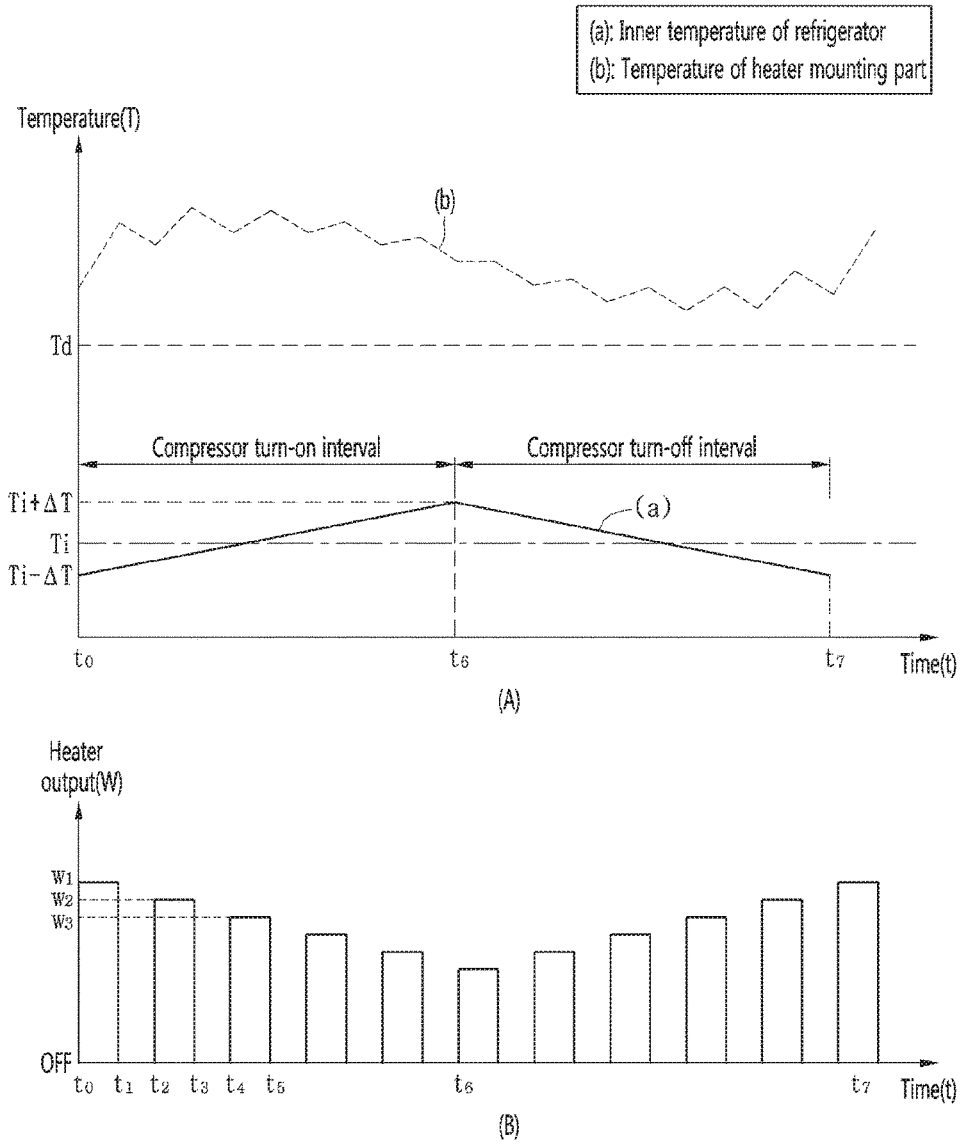

[Fig. 8]
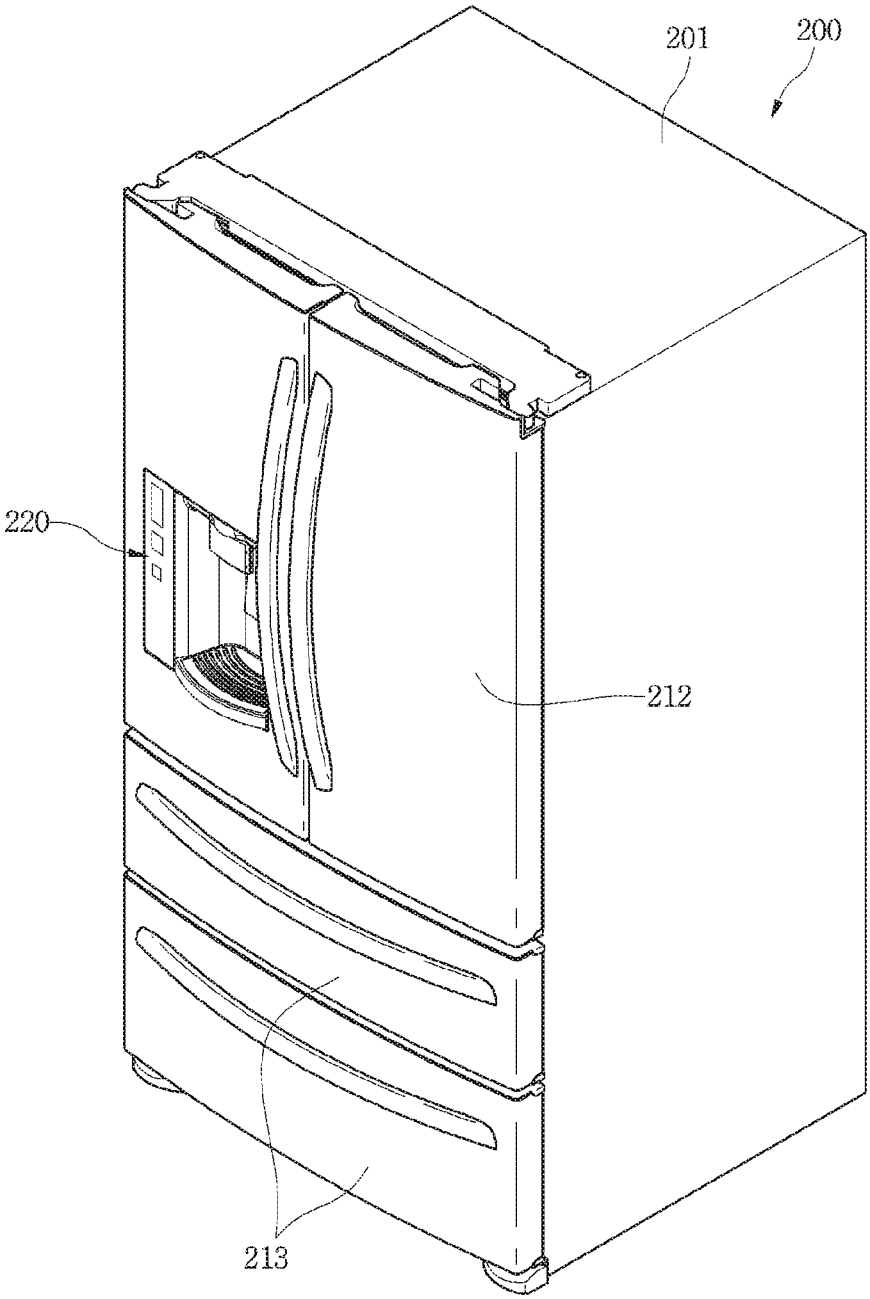

[Fig. 9]
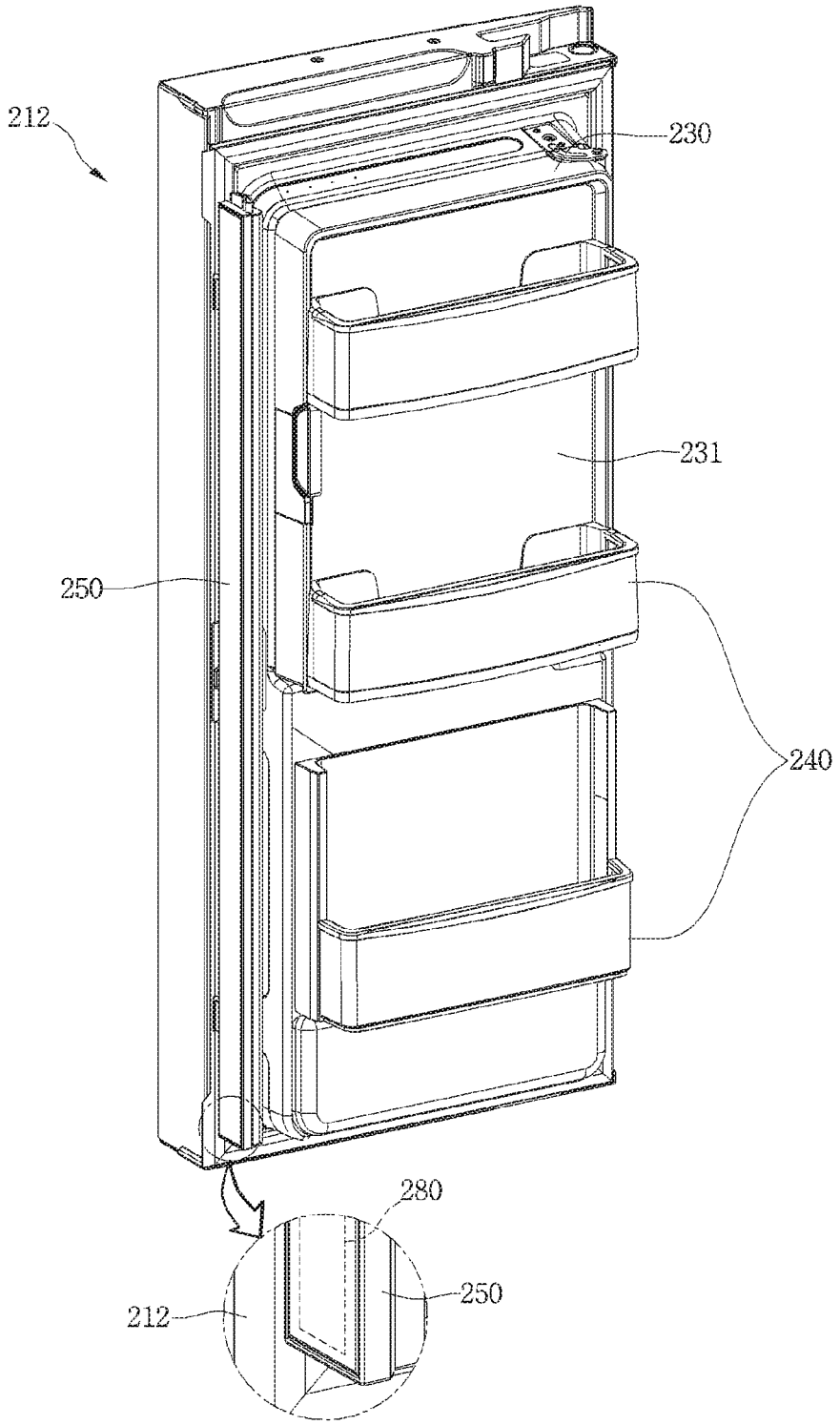

[Fig. 10]
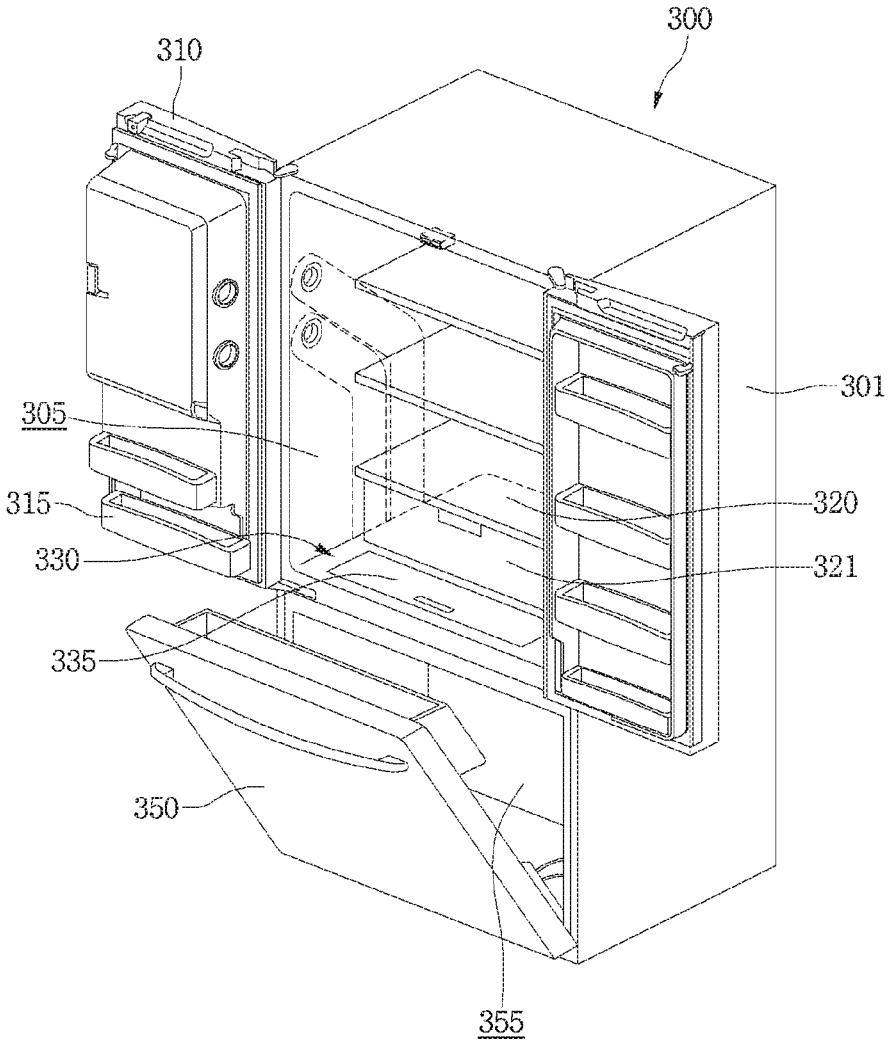

[Fig. 11]
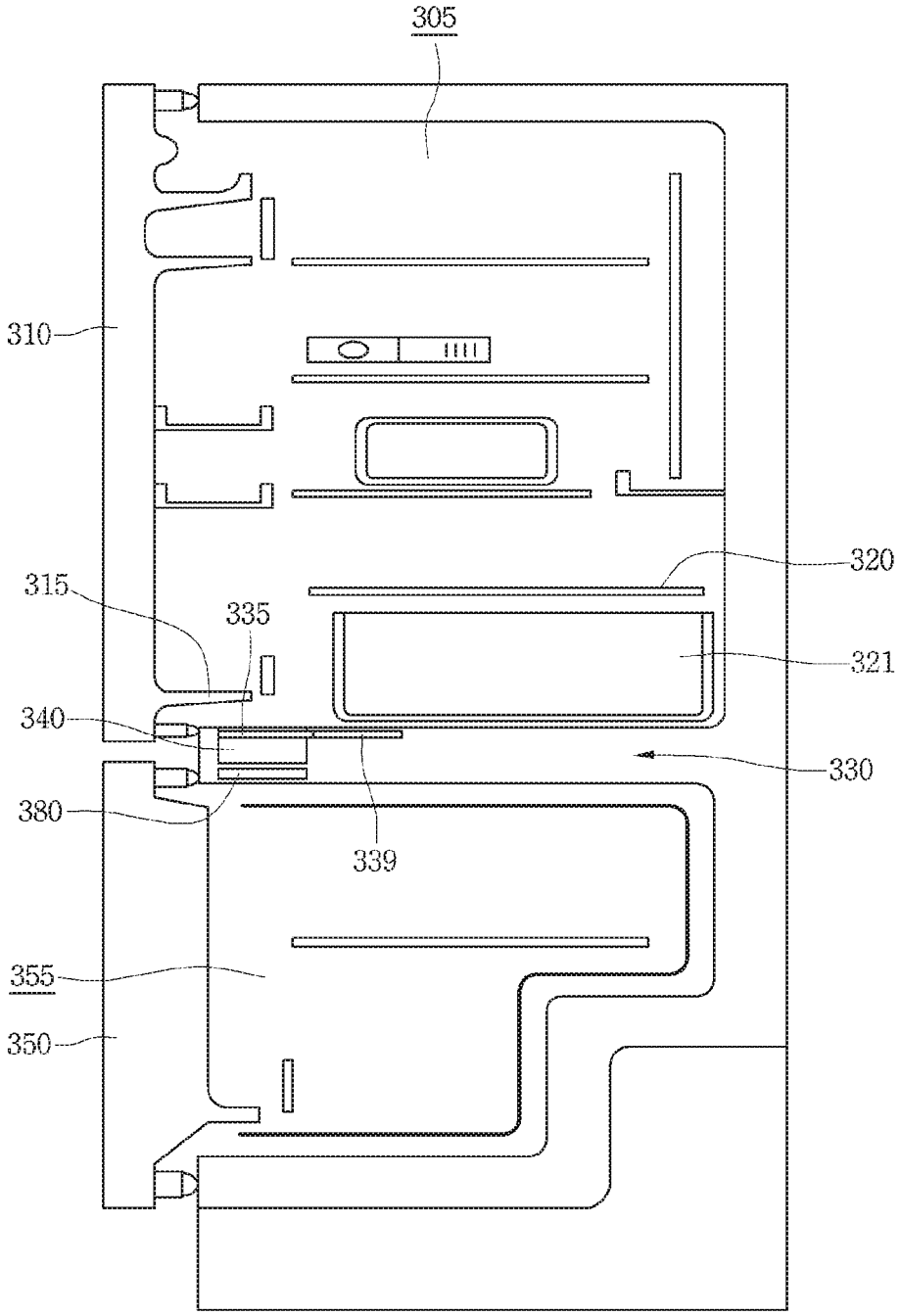

[Fig. 12]
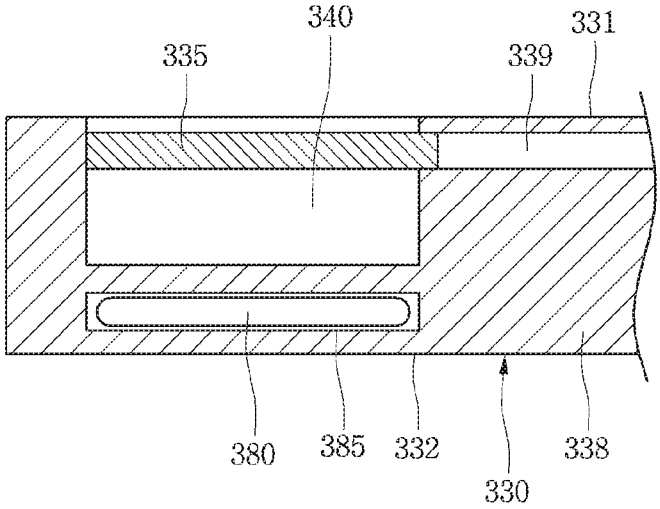

REFRIGERATOR AND METHOD FOR CONTROLLING THE SAME

CROSS-REFERENCE TO RELATED PATENT APPLICATIONS

This application is a U.S. National Stage Application under 35 U.S.C. § 371 of PCT Application No. PCT/KR2016/000655, filed Jan. 21, 2016, which claims priority to Korean Patent Application No. 10-2015-0009909, filed Jan. 21, 2015, whose entire disclosures are hereby incorporated by reference.

TECHNICAL FIELD

The present disclosure relates to a refrigerator and a method for controlling the same.

BACKGROUND ART

In general, a refrigerator has a plurality of storage compartments for accommodating foods to be stored so as to store the foods in a frozen or refrigerated state. Also, each of the storage compartments may have one surface that is opened to accommodate or dispense the foods. The plurality of storage compartments include a freezing compartment for storing foods in the frozen state and a refrigerating compartment for storing foods in the refrigerated state.

A refrigeration system in which a refrigerant is circulated is driven in the refrigerator. The refrigeration system may include a compressor, a condenser, an expansion device, and an evaporator.

The refrigerator may include a heater for preventing dew from being formed on a surface of the refrigerator due to a difference in temperature between air outside the refrigerator and the inside of the refrigerator. As the difference in temperature between the air outside the refrigerator and the inside of the refrigerator increases, and humidity of the air outside the refrigerator increases, dew may be further formed.

The heater provided in the refrigerator according to the related art may be controlled so that the heater is turned on/off to a preset operation factor on the basis of information with respect to a temperature and humidify of air outside the refrigerator, regardless of a high or low inner temperature of the refrigerator. Due to the operation of the heater, unnecessary power may be consumed.

That is, if the inside of the refrigerator has a relatively high temperature, the possibility of formation of dew may be reduced, but unnecessary power may be consumed because the heater is driven at a preset operation factor or output. Particularly, since the heater of a plurality of power consumption units constituting the refrigerator is a power consumption unit that requires large amount of power in addition to a compressor, the power consumption due to the driving of the heater may exceed a negligible level.

The prior document related with the refrigerator according to the related art as follows.

1. Application number (Filing Date): KR 10-2013-0004514 (Jan. 14, 2013)

2. Title of The Invention: DEW FORMATION PREVENTION METHOD FOR REFRIGERATOR

DISCLOSURE OF INVENTION

Technical Problem

Embodiments provide a refrigerator that is capable of reducing power consumption and a method for controlling the same.

Solution to Problem

In one embodiment, a refrigerator includes: a cabinet defining a storage compartment; a door selectively opening or closing the storage compartment; a heater disposed in the cabinet or door to prevent dew from being formed on a surface of the cabinet or door; a refrigerator temperature sensor detecting a temperature of the storage compartment of the refrigerator; and a control unit adjusting an operation factor or output of the heater on the basis of a temperature value detected by the refrigerator temperature sensor.

The control unit may control the heater to decrease the operation factor of the heater when the temperature of the storage compartment detected by the refrigerator temperature sensor increases, and the control unit may control the heater to increase the operation factor of the heater when the temperature of the storage compartment decreases.

The control unit may control the heater to decrease the output of the heater when the temperature of the storage compartment detected by the refrigerator temperature sensor increases, and the control unit may control the heater to increase the output of the heater when the temperature of the storage compartment decreases.

The refrigerator may further include a detection unit detecting a dew point temperature, wherein the detection unit may include: an external air temperature sensor detecting a temperature of external air; and an external air humidity sensor detecting a humidity of the external air.

The refrigerator may further include: a heater mounting part disposed in the cabinet or door and on which the hater is disposed; and a heater mounting part temperature sensor detecting a temperature of the heater mounting part.

The control unit may control an operation of the heater so that the temperature of the heater mounting part is above the dew point temperature detected by the detection unit.

The refrigerator may further include a memory part mapping and storing the operation factor or output of the heater on the basis of the information with respect to the dew point temperature and the inner, temperature of the refrigerator, which are detected by the detection device.

The refrigerator may further include: a set temperature input unit inputting a set temperature of the storage compartment; and a compressor controlled to be turned on or off in an interval between a first temperature that is higher than the set temperature and a second control temperature that is lower than the set temperature when the set temperature is inputted through the set temperature input unit.

The operation factor or output of the heater when the temperature of the storage compartment reaches the second control temperature may be greater than that of the heater when the temperature of the storage compartment reaches the first control temperature.

The heater may include a home bar heater disposed in a home bar provided in the door.

The door truly include a pair of refrigerating compartment doors that open or close the refrigerating compartment, and the heater may be disposed in a pillar provided in one door of the pair of refrigerating compartment doors.

The refrigerator may further include: a partition wall partitioning a refrigerating compartment and a freezing compartment of the storage compartment from each other; and an accommodation part disposed inside the partition wall to accommodate foods, wherein the heater may be disposed on one side of the accommodation part.

In another embodiment, a method for a refrigerator including a heater disposed in a cabinet or door of the refrigerator to prevent dew from being formed includes: detecting a temperature of a storage compartment through a refrigerator temperature. sensor provided in the storage compartment of the refrigerator; and adjusting an output or operation factor of the heater on the basis of information that is previously mapped with respect to the detected temperature of the storage compartment and an operation of the heater, wherein, when the detected temperature of the storage compartment is higher than a set temperature, the output or operation factor of the heater decreases, and when the detected temperature of the storage compartment is lower than a set temperature, the output or operation factor of the heater increases.

The method may further include: determining a dew point temperature on the basis of information detected by an external air temperature sensor and an external air humidity sensor; and controlling the operation factor or output of the heater so that a temperature of a heater mounting part on which the heater is mounted is above the dew point temperature.

Advantageous Effects of Invention

According to the proposed embodiments, the operation factor or output of the heater may be adjusted based on the information with respect to the inner temperature of the refrigerator. Also, since the heater is driven as power as need be, the unnecessary power consumption may be reduced.

Particularly, if the refrigerator has a relatively high inner temperature, since the possibility of the dew formation is reduced, the operation factor or the output f the heater may be reduced to reduce the power consumption. On the other hand, if the refrigerator has a relatively low inner temperature, the operation factor or the output of the refrigerator may be reduced to prevent the dew from being formed.

Also, since the refrigerator is controlled so that the temperature of the surface the place on which the heater is installed is detected, and the surface temperature is maintained to the dew point temperature or more, the dew formation may be easily prevented.

Also, the heater may be disposed in the home bar, the pillar, and the accommodation part of the partition wall and controlled to reduce the power consumption. Thus, the power consumption of the refrigerator may be significantly reduced.

BRIEF DESCRIPTION OF DRAWINGS

FIG. 1 is a perspective view of a refrigerator according to a first embodiment.

FIG. 2 is a view illustrating a home bar of the refrigerator according to the first embodiment.

FIG. 3 is a block diagram of the refrigerator according to the first embodiment.

FIG. 4 is a flowchart illustrating a method for controlling the refrigerator according to the first embodiment.

FIG. 5 is a graph illustrating a process in which a heater is controlled according to a variation in inner temperature of the refrigerator according to the first embodiment.

FIG. 6 is a flowchart illustrating a method for controlling a refrigerator according to a second embodiment.

FIG. 7 is a graph illustrating a process in which a heater is controlled according to a variation in inner temperature of the refrigerator according to the second embodiment.

FIGS. 8 and 9 are perspective views of a refrigerator according to a third embodiment.

FIGS. 10 to 12 are perspective views of a refrigerator according to a fourth embodiment.

MODE FOR THE INVENTION

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

FIG. 1 is a perspective view of a refrigerator according to a first embodiment, and FIG. 2 is a view illustrating a home bar of the refrigerator according to the first embodiment.

Referring to FIGS. 1 and 2, a refrigerator 1 according to a first embodiment includes a cabinet 10 defining a storage compartment and having an opened front surface and a door 20 for selectively covering the opened front surface of the cabinet 10.

The storage compartment includes a freezing compartment and a refrigerating compartment. The freezing compartment and the refrigerating compartment may be partitioned by a partition wall. A compressor 70, a condenser, and an evaporator may be installed in the cabinet 10.

The door 20 includes a freezing compartment door disposed on a front side of the freezing compartment and a refrigerating compartment door 24 disposed on a front side of the refrigerating compartment. The freezing compartment door 22 and the refrigerating compartment door 24 may be rotatably disposed.

A dispenser 30 through which ice or water is dispensed and a home bar 50 through foods stored in the storage compartment are easily taken out are provided on the door 20.

For example, the dispenser 30 may be provided on the freezing compartment door 22, and the home bar 50 may be provided on the refrigerating compartment door 24. For another example, the dispenser 30 may be removed, and the home bar may also be provided on the freezing compartment door 22.

The home bar 50 includes a home bar frame 51 and a home bar door 60. The home.

bar frame 51 is mounted on the door 20 and has a rectangular frame shape to define an opening 52 through which foods are accessible. A front/rear width of the home bar frame 51 may correspond to a thickness of the door 20, and the opening 52 may completely pass through the door 20.

Also, the home bar frame 51 may be disposed to correspond to a circumference of a rear surface of the home bar door 60 so that the home bar frame 51 is closely attached to the rear surface of the home bar door 60. That is, an inner surface of the home bar frame 51 may be stepped in multi stages and closely attached to the home bar door 60.

A gasket 53 is mounted on a circumference of a front surface of the home bar frame 51. When the home bar door 60 is closed, the gasket 53 may be closely attached to the rear surface of the home bar door 60, and thus, the opening 52 may be covered to the home bar door 60 by the gasket 53.

A latch groove 54 coupled to a latch 63 of the home bar door 60 and then caught by the latch 63 when the home bar door 60 is closed may be defined in an upper portion of the home bar frame 51. A switch 55 for detecting an open or close of the home bar door 60 is disposed at a side of the latch groove 54.

A lower portion of the home bar door 60 may be coupled to a hinge 61, and an upper portion of the home bar door 60 may rotate about the hinge 61. The hinge 61 may be disposed on each of lower portions of both sides of the home bar door 60.

A heater 80 for generating heat is provided in the home bar door 60. The heater 80 may be understood as a heating device for preventing dew from being formed on a surface of the cabinet 10 or the door 20, for example, the home bar door 60 or the home bar frame 51. The heater 80 may generate heat when power is applied thereto. The heater 80 may have a wire shape or film shape.

The heater 80 is mounted inside the home bar door 60 to contact the rear surface of the home bar door 60. Also, the home bar heater 80 may be disposed on a surface on which the gasket 53 and the home bar door 60 contact each other when the home bar door 60 is closed and also be disposed outside the gasket 53.

A portion of the rear surface of the home bar door 60, which contacts the gasket 53 may be disposed close to a portion within the refrigerator contacting cool air and have a relatively thin thickness, and thus, may be adjacent to external air. As a result, dew may be easily formed on the portion of the rear surface of the home bar door 60, which contacts the gasket 53. Thus, the heater 80 may be disposed adjacent to the portion of the rear surface of the home bar door 60, which contacts the gasket 53. For another example, the heater 80 may be adjacent to the gasket 53 and disposed on one surface of the home bar frame 51.

The refrigerator 1 may further include a power line 62 for supplying power to the heater 80. The power line 62 may be guided to the heater 80 through the hinge 61.

A heater mounting part temperature sensor 130 mounted on one surface of the home bar door 60 to detect a surrounding temperature of the heater 80, i.e., a portion on which the heater 80 is mounted (hereinafter, referred to as a heater mounting part). For example, the heater mounting part temperature sensor 130 may be adjacent to the heater 80 and mounted on an installation surface of the heater 80. When a temperature detected by the heater mounting part temperature sensor 130 is less than a dew point temperature, dew may be formed.

FIG. 3 is a block diagram of the refrigerator according to the first embodiment, and FIG. 4 is a flowchart illustrating a method for controlling the refrigerator according to the first embodiment.

Referring to FIG. 3, the refrigerator 1 according to the first embodiment includes a dew point temperature detection unit 110 for detecting a reference temperature at which the dew is formed, i.e., the dew point temperature.

For example, the dew point temperature detection unit 110 may include an external air temperature sensor for detecting a temperature of external air outside the refrigerator 1 and a humidity sensor for detecting humidity of the external air outside the refrigerator 1. The dew point temperature may be determined on the basis of information detected by the external air temperature sensor and the humidity sensor. The information with respect to the external air temperature and the external air humidity and the information with respect to the dew point temperature may be mapped and then stored in a memory unit 150.

The refrigerator 1 may further include a refrigerator temperature sensor 120 for detecting a temperature of the storage compartment of the refrigerator 1. The refrigerator temperature sensor 120 may be installed in the storage compartment. The refrigerant temperature sensor 120 may include a refrigerating compartment temperature sensor for detecting a temperature of the refrigerating compartment and a freezing compartment temperature sensor for detecting a temperature of the freezing compartment.

The refrigerator 1 may further include a set temperature input unit 140 for performing an input function to set the temperature of the storage compartment of the refrigerator 1. The set temperature input unit 140 may include a refrigerating compartment input part for inputting the set temperature information of the refrigerating compartment and a freezing compartment input part for inputting the set temperature information of the freezing compartment.

The refrigerator 1 further includes the memory unit 150 for mapping and storing the temperature information detected by the refrigerator temperature sensor 120 and the information with respect to the operation factor of the heater 150. Also, the refrigerator 1 may further include a timer for integrating an operation time of the heater 80.

The refrigerator 1 further includes a control unit 100 for controlling the compressor 70 and the heater 80. The control unit 100 may adjust the operation factor of the heater 80 on the basis of the temperature information detected by the refrigerator temperature. sensor 120. The operation factor of the heater 80 may be understood as a ratio of an on time to the total on/off time of the heater 80.

For example, if the temperature information detected by the refrigerator temperature sensor 120 is relatively high, the operation of the heater 80 is controlled so that the operation factor of the heater 80 increases. On the other hand, if the detected temperature information is relatively low, the operation of the heater 80 is controlled so that the operation factor of the heater 80 decreases.

Also, the control unit 100 may control the operation of the heater 80 so that the temperature detected by the heater mounting part temperature sensor 130 is less than the dew point temperature that is determined on the basis of the temperature information detected by the dew point temperature detection unit 110.

The mapped information, which is stored in the memory unit 150, with respect to the operation factor of the heater 80 according to the inner temperature of the refrigerator 1 may be information that is determined by reflecting the information with respect to the dew point temperature. That is, the information with respect to the operation factor of the heater 80, which is determined on the basis of the external air temperature, the external air humidify, and the inner temperature of the refrigerator may be previously stored in the memory unit 150.

When the set temperature is inputted through the set temperature input unit 140, the control unit 100 may control turn-on or off of the compressor 70 so that the temperature of the storage compartment is maintained between a first control temperature that is higher than the set temperature and a second control temperature that is less than the set temperature.

For example, when the temperature of the storage compartment increases to reach the first control temperature, the control unit 100 drives the compressor 70. On the other hand, when the temperature of the storage compartment decreases to reach the second control temperature, the control unit 100 may turn the compressor 70 off.

Information with respect to the first and second control temperatures according to the inputted set temperature may be stored in the memory unit 150.

Referring to FIG. 4, a method for controlling the refrigerator according to the current embodiment will be described.

When the refrigerator 1 is turned on, and the compressor 70 is driven, a refrigeration cycle according to compression, condensation, expansion, and evaporation of a refrigerant may operate (S11).

The external air temperature and the external air humidity may be detected by the dew point temperature detection unit 110, and the dew point temperature may be determined by the detected external air temperature and the detected external air humidity.

When the temperature detected by the heater mounting part temperature sensor 130 is less than the dew point temperature, dew may be formed on the surface of the home bar 50, e.g., the surface of the home bar frame 51 or the home bar door 60. Thus, the control unit 100 may control the operation of the heater 80 so that the temperature of the heater mounting part is not less than the dew point temperature (S12).

The inner temperature of the refrigerator 1 may be detected (S13). The information with respect to the detected inner temperature of the refrigerator 1 and the operation factor of the heater 80 may be previously mapped and then stored in the memory unit 150. The control unit 100 may determine the operation factor of the heater 80 on the basis of the detected inner temperature of the refrigerator 1 and then control the operation of the heater 80 on the basis of the determined operation factor (S14).

FIG. 5 is a graph illustrating a process in which the heater is controlled according to a variation in inner temperature of the refrigerator according to the first embodiment.

Referring to FIGS. 5A and 5B, when a user inputs a set temperature Ti of the storage compartment of the refrigerator, the control unit 100 controls turn-on or off of the compressor 70 in a control interval between a first control temperature (Ti-ΔT) that is higher by a set value ΔT than the set temperature Ti and a second control temperature (MΔT) that is lower by the set value ΔT than the set temperature Ti.

In detail, when the inner temperature of the refrigerator decreases to reach the second control temperature at a time t0, the compressor 70 may be turned off. On the other hand, when the inner temperature of the refrigerator increases to reach the first control temperature at a time t6, the compressor 70 may be turned on. Also, when the inner temperature of the refrigerator decreases to reach the second control temperature at a time t7, the compressor 70 may be turned off again. This control cycle of the compressor 70 may be repeated.

As a result, the compressor 70 may be turned off in the interval (compressor turn-off interval) of the times t0 to 6 and turned on in the interval (compressor turn-on interval) of the times t6 to t7.

The temperature information detected by the heater mounting part temperature sensor 130 may be monitored. The operation factor or output of the heater 80 may be controlled so that the temperature of the heater mounting part is higher by the set value than a dew point temperature Td to prevent the temperature detected by the heater mounting part temperature sensor 130 is not less than the dew point temperature Td. For example, if the determined dew point temperature is about 19 degrees, a temperature value that is higher by about 2 degrees than the dew point temperature may be determined as a target temperature of the heater mounting part.

Also, the temperature of the heater mounting part may repeatedly increase or decrease according to the turn-on or off control of the heater 80.

The heater 80 may operate at the operation factor that is determined on the basis of the inner temperature value of the refrigerator 1. That is, as the inner temperature of the refrigerator is high, since a different between the inner temperature of the refrigerator and the external air temperature is low to reduce the possibility of the formation of the dew, the operation factor of the heater 80 is controlled to be decreased. On the other hand, as the inner temperature of the refrigerator is low, since a different between the inner temperature of the refrigerator and the external air temperature is high to increase the possibility of the formation of the dew, the operation factor of the heater 80 is controlled to be increased.

In the current embodiment, the output of the heater 80 may be uniformly maintained.

In detail, in FIG. 5B, the temperature of the storage compartment of the refrigerator may be detected at the time t0 by using the refrigerator temperature sensor 120. Of cause, the freezing compartment or the refrigerating compartment may be provided in the storage compartment. The detected temperature of the storage compartment may approach the second control temperature (Ti-ΔT) that is relatively low. Thus, the operation factor of the heater 80 may increase, i.e., the turn-on time (t1-t0) of the heater 80 may relatively increase.

When reaching the time t1, the heater 80 may be turned off. Also, the heater 80 may be maintained to the turn-off state at the interval of the times t1 to t2.

The temperature of the storage compartment of the refrigerator may be detected at the time t2 by using the refrigerator temperature sensor 120. The detected temperature of the storage compartment may be higher than the second control temperature and lower than the first control temperature. Thus, the operation factor of the heater 80 may decrease, and the turn-on time (t 3-t2) of the heater 80 may be less than the turn-on time (t2-t1).

When reaching the time t 3, the heater 80 may be turned off. Also, the heater 80 may be maintained to the turn-off state at the interval of the times t3 to t4. For example, the turn-off interval, the time (t2-t1), and the time (t4-43) may be the same.

The temperature of the storage compartment of the refrigerator may be detected at the time t4. The detected temperature of the storage compartment may be higher than the temperature that is detected at the time t2. Thus, the operation factor of the heater 80 may decrease again, and the turn-on time (t5-t4) of the heater 80 may be less than the turn-on time (t3-t2).

The decrease of the operation factor or time of the heater 80 may be performed until the temperature of the storage compartment reaches the first control temperature (Ti+ΔT), i.e., a time t6. Thus, the heater 80 may have the lowest operation factor at the time t6.

Thereafter, the compressor 70 may be driven to reduce the temperature of the storage compartment. Also, the operation factor or time of the heater 80 may increase to correspond to the decreasing temperature of the storage compartment. Also, the increase of the operation factor or time of the heater 80 may be performed until the temperature of the storage compartment reaches the second control temperature (Ti-ΔT), i.e., a time t7.

For example, referring to FIG. 5B, the operation factor or time of the heater 80 may be symmetrical to each other toward the times t0 and t7 with respect to the time t6 at which the compressor 70 is converted from the turn-off state into the turn-on state. That is, the operation factor or time of the heater 80 may gradually increase to correspond to the decreasing temperature of the storage compartment with respect to the time t6.

1891 In other words, the operation factor of the heater 80 when the inner temperature of the refrigerator reaches the second control temperature may be greater than that of the heater 80 when the inner temperature of the refrigerator reaches the first control temperature.

1901 As described above, when the inner temperature of the refrigerator is higher than the set temperature on the basis of the inner temperature of the refrigerator, the operation factor of the heater 80 may decrease. On the other hand, when the inner temperature of the refrigerator is lower than the set temperature, the operation factor of the heater 80 may increase. Thus, the unnecessary power consumption may be prevented.

Hereinafter, a second embodiment will be described. Since the current embodiment is the same as the first embodiment except for a control method of the heater, different parts between the first and second embodiments will be described principally, and descriptions of the same parts will be denoted by the same reference numerals and descriptions of the first embodiment.

FIG. 6 is a flowchart illustrating a method for controlling a refrigerator according to a second embodiment, and FIG. 7 is a graph illustrating a process in which a heater is controlled according to a variation in inner temperature of the refrigerator according to the second embodiment.

Referring to FIG. 6, when a refrigerator 1 is turned on, and a compressor 70 is driven, a refrigeration cycle according to compression, condensation, expansion, and evaporation of a refrigerant may operate (S21).

An external air temperature and external air humidity may be detected by a dew point temperature detection unit 110, and the dew point temperature may be determined by the detected external air temperature and the detected external air humidity. A control unit 100 may control an operation of a heater 80 so that a temperature of a heater mounting part is not less than the dew point temperature (S22).

An inner temperature of the refrigerator 1 may be detected (S23). The detected inner temperature of the refrigerator 1 and information with respect to an output of the heater 80 may be mapped. The control unit 100 may determine the output of the heater 80 on the basis of the detected inner temperature of the refrigerator 1 and then control the operation of the heater 80 on the basis of the determined output of the heater 80.

Also, the output of the heater 80 may be mapped and stored in a memory unit on the basis of information with respect to the dew point temperature determined by the external air temperature and the external air humidify and the inner temperature of the refrigerator (S24).

Referring to FIGS. 7A and 7B, when a user inputs a set temperature Ti of a storage compartment of the refrigerator, the control unit 100 controls turn-on or off of the compressor 70 in a control interval between a first control temperature (Ti+ΔT) that is higher by a set value ΔT than the set temperature Ti and a second control temperature (Ti-ΔT) that is lower by the set value ΔT than the set temperature Ti. The compressor 70 may be turned off in an interval (compressor turn-off interval) of times t0 to t6 and turned on in an interval (compressor turn-on interval) of times t6 to t7.

The heater 80 may be controlled on that the temperature of the heater mounting part is higher by a set value than a dew point temperature Td to prevent the temperature detected by the heater mounting part temperature sensor 130 is not less than the dew point temperature Td. Also, the temperature of the heater mounting part may repeatedly increase or decrease according to the output control of the heater 80.

The heater 80 may operate at the output that is determined on the basis of the inner temperature value of the refrigerator 1. That is, as the inner temperature of the refrigerator is high, since a different between the inner temperature of the refrigerator and the external air temperature is low to increase the possibility of the formation of the dew, the output of the heater 80 is controlled to be decreased. On the other hand, as the inner temperature of the refrigerator is low, since a different between the inner temperature of the refrigerator and the external air temperature is high to increase the possibility of the formation of the dew, the output of the heater 80 is controlled to be increased.

In the current embodiment, the operation factor or turn-on time of the heater 80 may be uniformly maintained.

In detail, in FIG. 7B, the temperature of the storage compartment of the refrigerator may be detected at the time t0 by using the refrigerator temperature sensor 120. The detected temperature of the storage compartment may approach the second control temperature (Ti-ΔT) that is relatively low. Thus, the heater 80 may have an output WI (a first output value) that is relatively high.

When reaching the time t1, the heater 80 may be turned off. Also, the heater 80 may be maintained to the turn-off state at the interval of the times to t2.

The temperature of the storage compartment of the refrigerator may be detected at the time t2 by using the refrigerator temperature sensor 120. The detected temperature of the storage compartment may be higher than the second control temperature and lower than the first control temperature. Thus, the output of the heater 80 may be reduced, Lind thus, the heater 80 have an output W2 (a second output value).

When reaching the time t3, the heater 80 may be turned off. Also, the heater 80 may be maintained to the turn-off state at the interval of the times t3 to t4. For example, the turn-off interval, the time (t2-t1), and the time (t4-43) may be the same.

The temperature of the storage compartment of the refrigerator may be detected at the time t4. The detected temperature of the storage compartment may be higher than the temperature that is detected at the time t2. Thus, the output of the heater 80 may be reduced, and thus, the heater 80 have an output W3 (a third output value).

The decrease of the output of the heater 80 may be performed until the temperature of the storage compartment reaches the first control temperature (Ti+ΔT), i.e., the time t6. Thus, the heater 80 may have the lowest output at the time t6.

Thereafter, the compressor 70 may be driven to reduce the temperature of the storage compartment. Also, the output of the heater 80 may increase to correspond to the decreasing creasing temperature of the storage compartment. Also, the increase of the output of the heater 80 may be performed until the temperature of the storage compartment reaches the second control temperature (Ti-ΔT), i.e., a time t7.

For example, referring to FIG. 7B, the output of the heater 80 may be symmetrical to each other toward the times t0 and a with respect to the time t6 at which the compressor 70 is converted from the turn-off state into the turn-on state. That is, the output of the heater 80 may gradually increase to correspond to the decreasing temperature of the storage compartment with respect to the time t6.

In other words, the output of the heater 80 when the inner temperature of the refrigerator reaches the second control temperature may be greater than that of the heater 80 when the inner temperature of the refrigerator reaches the first control temperature. As described above, when the inner temperature of the refrigerator is higher than the set temperature on the basis of the inner temperature of the refrigerator, the output of the heater 80 may decrease. On the other hand, when the inner temperature of the refrigerator is lower than the set temperature, the output of the heater 80 may increase. Thus, the unnecessary power consumption may be prevented.

Hereinafter, third and fourth embodiments will be described. Since the current embodiment is the same as the foregoing embodiments except for an installation position of the heater, different parts between the current embodiment and the foregoing embodiments will be described principally, and descriptions of the same parts will be denoted by the same reference numerals and descriptions of the foregoing embodiments. Particularly, the technical features described with reference to FIGS. 3 to 7 may be equally applied to the third and fourth embodiments.

FIGS. 8 and 9 are perspective views of a refrigerator according to a third embodiment.

Referring to FIGS. 8 and 9, a refrigerator 200 according to a third embodiment includes a cabinet 201 having a refrigerating compartment and a freezing compartment therein, a pair of refrigerating compartment doors 212 rotatably coupled to a front surface of the cabinet 201 to open or close the refrigerating compartment, and a freezing compartment door 213 disposed to stand up on the front surface of the cabinet 201 and slidably moving in a front/rear direction to open or close the freezing compartment.

The refrigerator 200 may further include a dispenser 220 disposed on a front surface of one of the pair of refrigerating compartment doors 212 to dispense ice or water.

A home bar may be provided in a front surface of the other refrigerating compartment door 212 in some products, and thus, foods stored in the refrigerating compartment may be taken out without opening the refrigerating compartment door 212. Also, an accommodation box may be integrally coupled to a rear surface of the freezing compartment door 212 and accommodated in the freezing compartment. Also, the freezing compartment may be partitioned into a plurality of spaces, and one of the partitioned spaces may be used as a convertible compartment. That is, the drawer-type door that slidably moves may be provided in plurality to open or close each of the freezing compartment and the convertible compartment.

An ice making chamber 230 for making and storing ice may be defined in the rear surface of the refrigerating compartment door 212. Also, an inner space of the ice making chamber 230 may be selectively opened or closed by an ice making chamber door 231. Also, a door basked 240 may be mounted on the rear surface of the refrigerating compartment door 212 and/or a rear surface of the ice making chamber door 231.

Both ends of each of the pair of refrigerating compartment doors 212 may be defined as a fixed end rotatably coupled to the cabinet 201 and a rotatable end corresponding to an opposite side of the fixed end. Here, the rotatable ends of the pair of refrigerating compartment doors 212 may contact each other to face each other when the refrigerating compartment is closed. On the other hand, a separate partition wall contacting the rotatable end of the refrigerating compartment door is not provided in the refrigerating compartment. Thus, the possibility of leakage of cool air may be high at the portion at which the rotatable ends of the pair of refrigerating compartment doors contact each other.

For this reason, a pillar 250 for preventing the cool air from leaking may be mounted on the refrigerating compartment door 212. In detail, the pillar 250 may be rotatably mounted on one of the pair of refrigerating compartment doors 212. Particularly, the pillar 250 may be mounted on a rear surface of the rotatable end of the refrigerating compartment door 212. Also, a guide member (not shown) for guiding rotation of the pillar 250 may be mounted on each of a ceiling surface and bottom surface of the refrigerating compartment. Thus, while the refrigerating compartment door 212 on which the pillar 250 is mounted is closed, one side of the pillar 250 may rotate to close the portion at which the pair of refrigerating compartment doors 212 contact each other.

Dew may be formed on side surfaces of the rotatable ends of the pair of refrigerating compartment doors. Particularly, the possibility of the formation of the dew may be relatively high at upper portions of the side surfaces when compared to lower portions of the side surfaces. This is done because the cool air within the refrigerating compartment has relatively low temperature and humidity than those of external air, and also, as the temperature of the cool air decreases, the cool air flows downward to the bottom due to density characteristics of the cold air. Thus, the possibility of the formation of the dew may be highest at the lower end of the door, which corresponds to a region in which a difference in temperature and humidity between the external air and the internal air of the refrigerator is the largest, and an amount of formed dew maybe very much.

Therefore, the refrigerator 200 according to the current embodiment may further include a heater 280 for preventing dew from being formed. The heater 280 may be disposed in the pillar 250, e.g., an inner surface of the pillar 250. Also, the number or output of heater 280 disposed in a lower portion of the pillar 250 at which the possibility of the formation of the dew is high may be greater than those of heater 280 disposed in an upper portion of the pillar 250. Descriptions with respect to a method for controlling the heater 280 will be derived from the control method according to the first and second embodiments.

FIGS. 10 to 12 are perspective views of a refrigerator according to a fourth embodiment.

Referring to FIGS. 10 to 12, a refrigerator 300 according to a fourth embodiment includes a cabinet 301 having a refrigerating compartment 305 and a freezing compartment 355 therein, a pair of refrigerating compartment doors 310 rotatably coupled to a front surface of the cabinet 301 to open or close the refrigerating compartment 305, and a freezing compartment door 350 disposed to stand up on the front surface of the cabinet 301 and slidably moving in a front/rear direction to open or close the freezing compartment 355.

Also, the refrigerator 300 further includes a partition wall 330 for partitioning the refrigerant compartment 305 and the freezing compartment 355 from each other. An insulation material 338 for insulating the refrigerating compartment 305 from the freezing compartment 355 may be disposed in the partition wall 330.

The refrigerating compartment door 310 includes a door basket 315. The door basket 315 may protrude from the refrigerating compartment door 310 in a direction of the refrigerating compartment, i.e., in a rear direction.

A plurality of shelves 320 and a vegetable box 321 may be disposed in the refrigerating compartment 305. The vegetable box 321 may be disposed under the lowermost shelf 320 of the plurality of shelves 320.

The refrigerator 300 further includes an accommodation part 340 disposed inside the partition wall 330 to provide a space in which foods are accommodated.

For example, the accommodation part 340 may be defined by being recessed from the partition wall 330. in detail, the accommodation part 340 may be further recessed from a top surface 331 of the partition wall 330 defining the bottom of the refrigerating compartment 305 in a direction of the freezing compartment, i.e., in a downward direction.

The refrigerator 300 further includes an accommodation part door 335 for opening or closing the accommodation part 340. The accommodation part door 335 may be movably disposed on the top surface 331 of the partition wall 330. For example, the accommodation part door 335 may be provided slidable in a front/rear direction of the refrigerating compartment 305.

The partition wall 330 includes a guide part 339 for guiding the movement of the accommodation part door 335. The guide part 339 may be disposed on each of both sides of the accommodation part door 335.

The refrigerator 300 further includes a heater 380 disposed on one side of the accommodation part 340. The heater 380 may be disposed to be seated on a heater seat part 385. The heater seat part 385 may be disposed under the accommodation part 340 and recessed. In other words, the heater 380 may be disposed between the accommodation part 340 and the bottom surface 332 of the partition wall 330.

The heater 380 may generate heat to prevent dew from being formed on an inner wall of the heater seat part 385. Descriptions with respect to a method for controlling the heater 380 will be derived from the control method according to the first and second embodiments.

The invention claimed is:

1. A refrigerator comprising:

a cabinet including a refrigerating compartment and a freezing compartment provided at a lower section of the refrigerating compartment;

a refrigerating compartment door configured to selectively open or close the refrigerating compartment;

a freezing compartment door configured to selectively open or close the freezing compartment;

a partition wall provided between the refrigerating compartment and the freezing compartment;

an insulation material provided within the partition wall;

a compartment recessed from a top surface of the partition wall, wherein the compartment extends a predetermined length in a first direction, the first direction extending from a front of the refrigerator toward a rear of the refrigerator;

a compartment lid provided above the compartment and configured to selectively open or close the compartment;

a receiving portion formed in the insulation material;

a heater mounted on the receiving portion, wherein the heater extends a predetermined length in the first direction such that the heater is provided underneath a majority of the compartment;

a refrigerator temperature sensor detecting a temperature of the refrigerating compartment or the freezing compartment of the refrigerator; and a control unit adjusting an operation factor or output of the heater on the basis of a temperature value detected by the refrigerator temperature sensor, wherein the insulation material includes:

a first insulation part provided between an upper portion of the heater and a bottom of the compartment; and a second insulation part provided between a lower portion of the heater and a bottom of the partition wall.

2. The refrigerator according to claim 1, wherein the control unit controls the heater to decrease the operation factor of the heater when the temperature detected by the refrigerator temperature sensor increases, and the control unit controls the heater to increase the operation factor of the heater when the temperature detected by the refrigerator temperature sensor decreases.

3. The refrigerator according to claim 1, wherein the control unit controls the heater to decrease the output of the heater when the temperature detected by the refrigerator temperature sensor increases, and the control unit controls the heater to increase the output of the heater when the temperature detected by the refrigerator temperature sensor decreases.

4. The refrigerator according to claim 1, further comprising a detection unit configured to detect a dew point temperature, wherein the detection unit comprises: an external air temperature sensor configured to detect a temperature of external air; and an external air humidity sensor configured to detect a humidity of the external air.

5. The refrigerator according to claim 4, further comprising a memory part configured to map and store the operation factor or output of the heater on the basis of the information with respect to the temperature detected by the refrigerator temperature sensor.

6. The refrigerator according to claim 1, further comprising:

a set temperature input unit configured to input a set temperature of the refrigerating compartment or the freezing compartment; and a compressor controlled to be turned on or off in an interval between a first temperature that is higher than the set temperature and a second control temperature that is lower than the set temperature when the set temperature is inputted through the set temperature input unit.

7. The refrigerator according to claim 6, wherein the operation factor or output of the heater when the temperature of the refrigerating compartment or the freezing compartment reaches the second control temperature is greater than that of the heater when the temperature of the refrigerating compartment or the freezing compartment reaches the first control temperature.

* * * * *